US008157569B1

(12) United States Patent
Liu

(10) Patent No.: US 8,157,569 B1
(45) Date of Patent: Apr. 17, 2012

(54) BIAXIALLY ROTATABLE ELECTRICAL CONNECTOR

(75) Inventor: Sheng-Jung Liu, Hong Kong (CN)

(73) Assignee: Longlife International Limited, Kowloon (HK)

( * ) Notice: Subject to any disclaimer, the term of this patent is extended or adjusted under 35 U.S.C. 154(b) by 0 days.

(21) Appl. No.: 13/023,527

(22) Filed: Feb. 8, 2011

(51) Int. Cl.
*H01R 39/00* (2006.01)

(52) U.S. Cl. ..... 439/11

(58) Field of Classification Search ..... 439/13, 439/18–28, 11, 6
See application file for complete search history.

(56) References Cited

U.S. PATENT DOCUMENTS 1,981,854 A * 11/1934 Comiskey ..... 439/6
5,425,645 A * 6/1995 Skovdal et al. ..... 439/23
6,695,620 B1 * 2/2004 Huang ..... 439/11
7,247,028 B2 * 7/2007 Schriefer ..... 439/11
7,494,343 B2 * 2/2009 Schriefer ..... 439/11

* cited by examiner

*Primary Examiner* — Gary F. Paumen
(74) *Attorney, Agent, or Firm* — Hershkovitz & Associates, LLC; Abraham Hershkovitz

(57) ABSTRACT

A biaxially rotatable electrical connector has a base and a rotary part. The rotary part has a rotary member and an insertion member. One end of the rotary member is pivotally connected with the base and is rotated around a first axis, the other end of the rotary member is pivotally connected with the insertion member so that the insertion member can be rotated around a second axis. The base and the rotary part are hollow and their inner spaces communicate with each other. Accordingly, the electrical connector can be flexibly rotated with multiple angular directions and does not conflict with or block other adjacent plug or socket when connected to an electronic device.

16 Claims, 9 Drawing Sheets

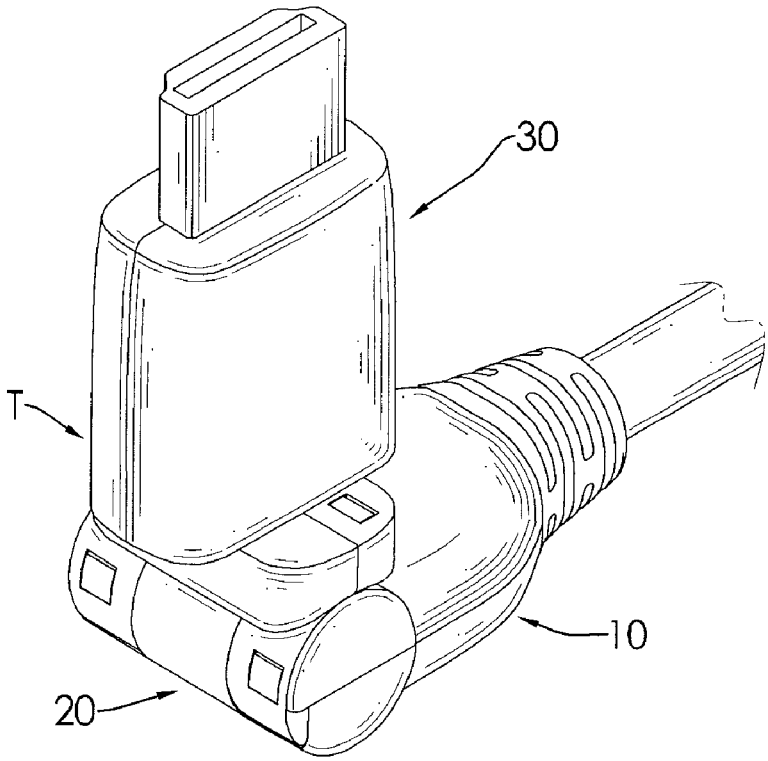
FIG.1B
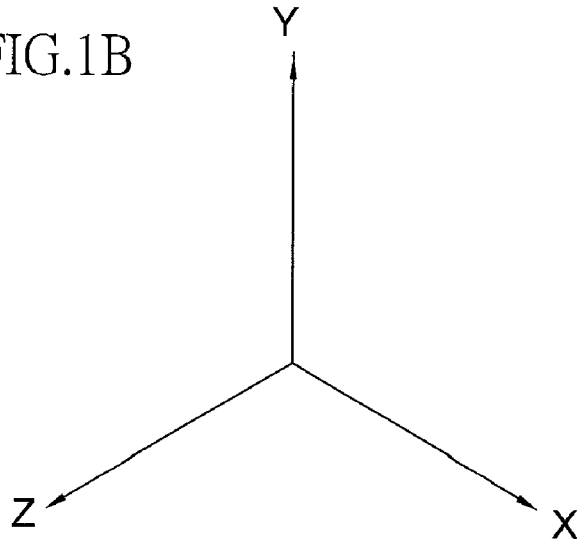

BIAXIALLY ROTATABLE ELECTRICAL CONNECTOR

BACKGROUND OF THE INVENTION

1. Field of the Invention

The present invention relates to an electrical connector, and more particularly to an electrical connector capable of varying orientation biaxially.

2. Description of the Related Art

Electrical connectors are connected between electronic products or to inner parts of electronic products to transmit signal therebetween or therefrom. Conventional electrical connectors usually have a housing and a terminal connector. The terminal connector is connected with one end of the housing for mating with other electrical connector. A transmission line is connected with another end of the housing and is covered by an insulating sheath. A junction portion between the transmission line and the housing is wrapped up by a flexible material so that the electrical connectors, when in use, can be plugged in connectors of electronic products for signal transmission.

An electronic device usually has various connectors mounted at one place of the device to collectively provide interfaces satisfying multiple communication protocols. However, when multiple electrical connectors are plugged in corresponding connectors of an electronic product at the same time, mutual conflict may arise and not all of the electrical connectors can be smoothly and respectively plugged in the intended sockets. Such drawback causes operational inconvenience.

SUMMARY OF THE INVENTION

An objective of the present invention is to provide an electrical connector capable of varying orientation biaxially.

To achieve the foregoing objective, the biaxially rotatable electrical connector has a base and a rotary part.

The base is hollow and has two holding arms formed on one end of the base. Each holding arm is hollow and has an inside surface and a first pivot opening. The inside surface faces that of the other holding arm. The first pivot opening is formed through the inside surface of the holding arm.

The rotary part has a rotary member and an insertion member. The rotary member is hollow and has a first end, a second end, a pivoting cylinder and a second pivot opening. The first end and the second end are mutually opposite. The pivoting cylinder has a through hole and two pivoting rings. The through hole is formed through the pivoting cylinder. The pivoting rings are respectively formed around and protrude outwardly from two openings of the through hole of the holding arms, respectively engage the first pivot openings of the holding arms, and are rotatable around a first axis. The second pivot opening is formed through a second end of the rotary member.

The insertion member is hollow, and has a through hole and a rotation collar. The through hole is formed through one end of the insertion member. The rotation collar is formed on and protrude outwardly and radially from an opening of the through hole of the insertion member, engages the second pivot opening of the rotary member, and is rotatable around a second axis.

Because the rotary member is pivotally connected with the base and is rotated around the first axis, and the insertion member is pivotally connected with the rotary member and is rotated around the second axis, the electrical connector can thus be biaxially rotatable. When the electrical connector is connected to an electronic device in a limited space, the electrical connector can be adjusted to take a linear, L-shaped or twisted form to elude and not to conflict with other adjacent connectors.

Other objectives, advantages and novel features of the invention will become more apparent from the following detailed description when taken in conjunction with the accompanying drawings.

BRIEF DESCRIPTION OF THE DRAWINGS

FIG. 1B is an operational perspective view of the biaxially rotatable electrical connector in FIG. 1A;

DETAILED DESCRIPTION OF THE INVENTION

Figure 1A:
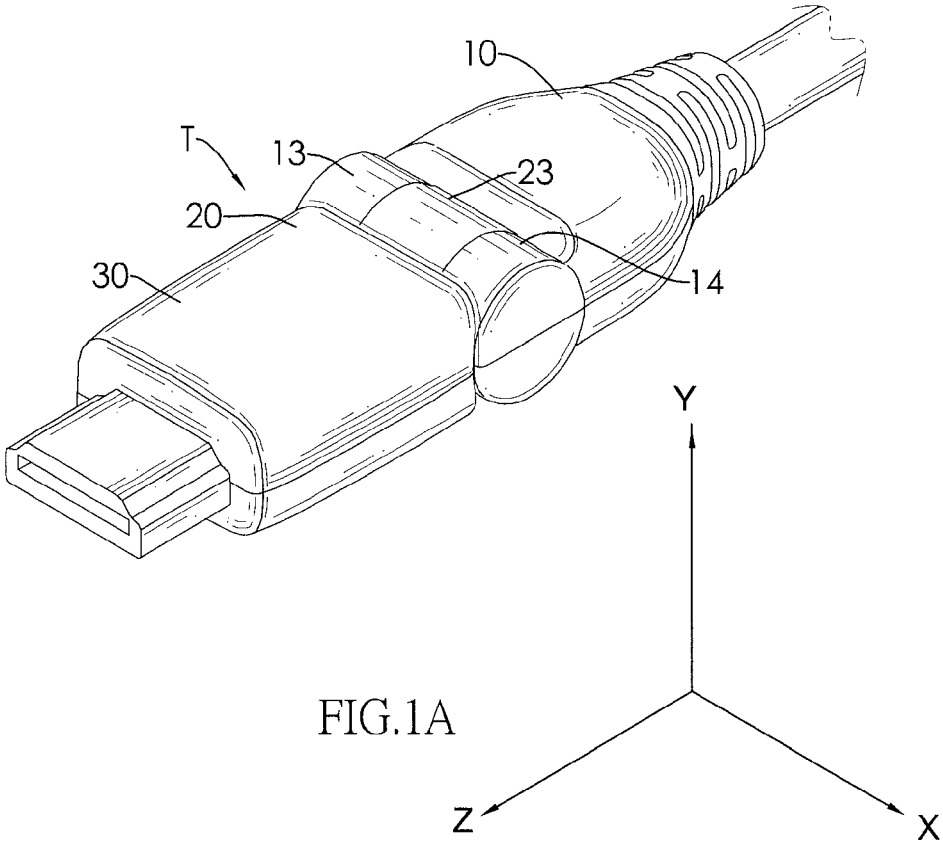
FIG. 1A is a perspective view of a first embodiment of a biaxially rotatable electrical connector in accordance with the present invention.

With reference to FIG. 1A, a first embodiment of a biaxially rotatable electrical connector in accordance with the present invention has a base 10 and a rotary part (T). The rotary part (T) is mounted on one end of the base 10, and has a rotary member 20 and an insertion member 30. To facilitate to describe how the orientation varies when rotary part (T) is rotated, a three-dimensional coordinate system including X, Y and Z axes, is presented. One end of the rotary member 20 is pivotally connected with the base 10, and is rotatable around the X-axis. The insertion member 30 is pivotally connected with an opposite end of the rotary member 20, and is rotatable around the Z-axis. With reference to FIG. 1B, the rotary member 20 and the insertion member 30 are respectively and simultaneously rotatable around the X-axis and the Z-axis.

Figure 2:
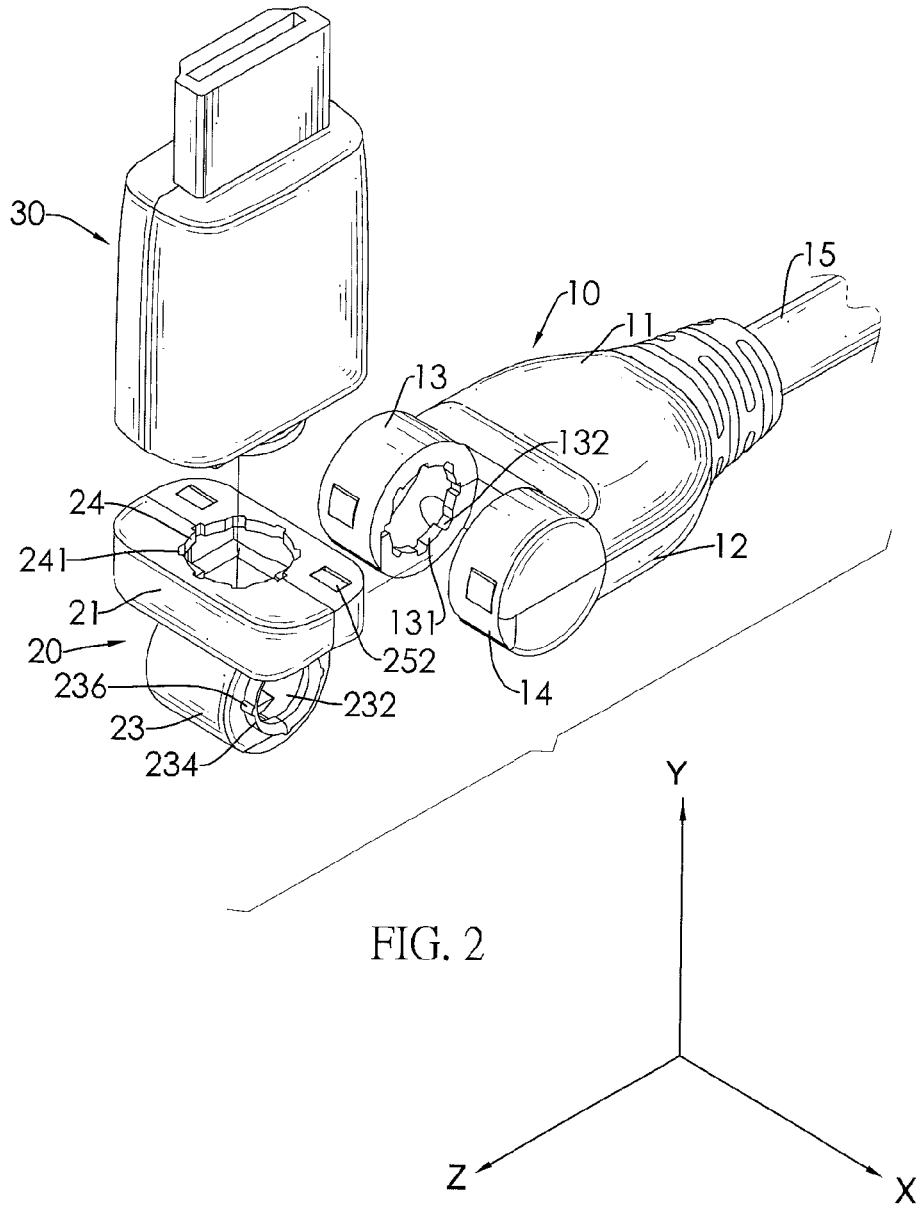
FIG. 2 is a partially exploded perspective view of the biaxially rotatable electrical connector in FIG. 1A.
Figure 3:
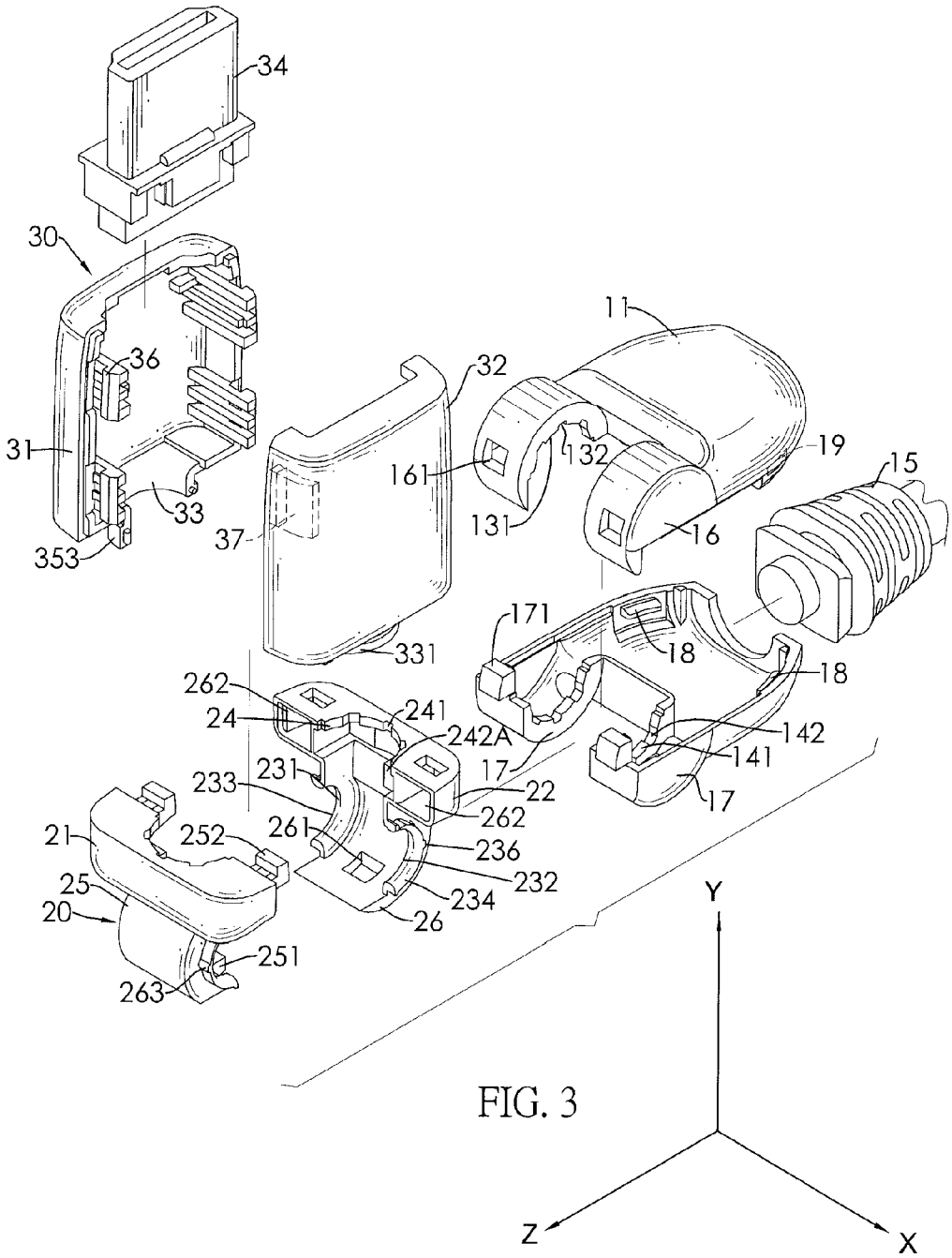
FIG. 3 is an exploded perspective view of the biaxially rotatable electrical connector in FIG. 1A.

With reference to FIGS. 2 and 3, the base 10 is hollow and has two holding arms 13, 14 formed on one end of the base 10. Each holding arm 13, 14 is hollow, and has an inside surface facing that of the other holding arm 14, 13, a first pivot opening 131, 141, and multiple first positioning cavities 132, 142. The first pivot opening 131, 141 is formed through the inside surface of the holding arm 13, 14. The first positioning cavities 132, 142 are formed in an inner wall of the first pivot opening 131, 141, and the first positioning cavities 132, 142 may be equiangularly spaced apart by an angle, for example 45°. The other end of the base 10 may be mounted to one end of a transmission line 15.

The base 10 is composed of an upper housing 11 and a lower housing 12 oppositely joined together to form the base 10. Each of the upper housing 11 and the lower housing 12 has a first end and a second end. Each holding arm 13, 14 is divided into an upper holding arm 16 and a lower holding arm 17 respectively formed on the first end of the upper housing 11 and the first end of the lower housing 12. The upper housing 11 has two insertion holes 161 and two engagement pieces. The insertion holes 161 are respectively formed through the upper holding arms 16. The engagement pieces are respectively formed on two opposite positions of an inner wall of the upper housing 11. Each engagement piece has a mouth 19 formed therethrough. The lower housing 12 has two insertion blocks 171 and two tongues 18. The insertion blocks 171 are respectively formed on the lower holding arms 17 to respectively engage the insertion holes 161 of the upper housing 11. The tongues 18 are respectively formed on two opposite positions of an inner wall of the lower housing 11 to respectively correspond to and engage the mouths 19 of the engagement pieces of the upper housing 11.

Figure 4:
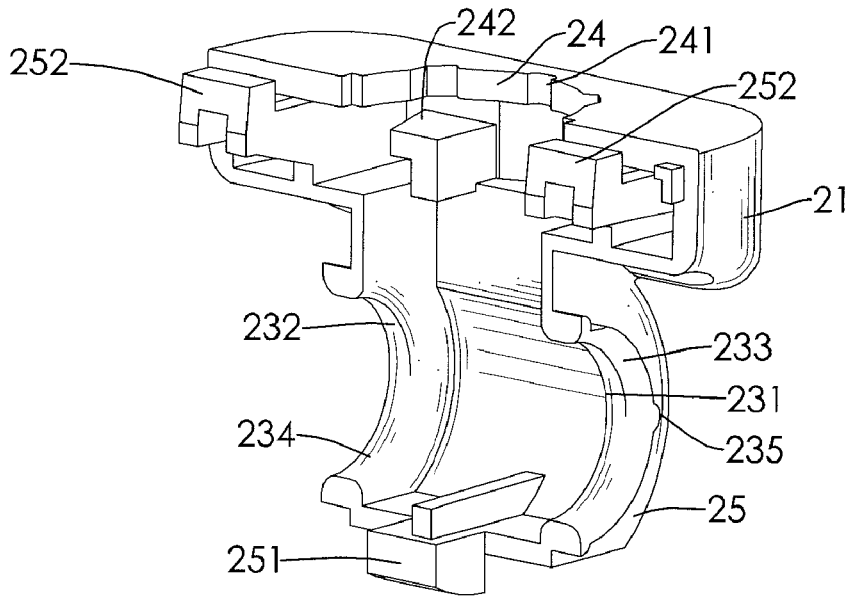
FIG. 4 is an enlarged perspective view of a first casing of a rotary member of the biaxially rotatable electrical connector in FIG. 3.

The rotary member 20 is hollow and has a first end, a second end, a pivoting cylinder 23, a second pivot opening 24 and multiple stoppers 242, 242A. The first end and the second end are mutually opposite. The pivoting cylinder 23 has a through hole 232 and two pivoting rings 233, 234. The through hole 232 is formed through the pivoting cylinder 23. With reference to FIG. 4, the pivoting rings 233, 234 are respectively formed around and protrude outwardly from two openings of the through hole 232, and have multiple positioning teeth 235, 236. The multiple positioning teeth 235, 236 are respectively formed on peripheries of the pivoting rings 233, 234, are rotatable around the X-axis to selectively engage corresponding first positioning cavities 132, 142 of the first pivot openings 131, 141, and may be equiangularly spaced apart by an angle, for example 90°. The second pivot opening 24 is formed through a second end of the rotary member 20, and has multiple second positioning cavities 241. The second positioning cavities 241 are formed in an inner wall of the second pivot opening 24, and may be equiangularly spaced apart by an angle, for example 45°. The stoppers 242, 242A are formed on an inner wall of the rotary member 20 and are adjacent to the second pivot opening 24.

The rotary member 20 is composed of a first casing 21, and a second casing 22 oppositely joined together to form the rotary member 20. Each of the first casing 12 and the second casing 22 has a first end and a second end. The pivoting cylinder 23 is divided into a first pivoting cylinder 25 and a second pivoting cylinder 26 respectively formed on the first end of the first casing 21 and the first end of the second casing 22 and oppositely joined together to form the pivoting cylinder 23. The first casing 21 has an engagement block 251 and a pair of buckle tongues 252. The engagement block 251 is formed on and protrudes from an inner wall of the first pivoting cylinder 25. The pair of buckle tongues 252 is formed on and protrudes from the second end of the first casing 21. The second casing 22 has an engagement hole 261 and a pair of buckle cavities 262. The engagement hole 261 is formed in an inner wall of the second pivoting cylinder 26, and corresponds to and engages the engagement block 251 of the first casing 21. The pair of buckle cavities 262 is formed in the second end of the second casing 22, and corresponds to and engages the pair of buckle tongues 252 of the first casing 21. In the present embodiment, the rotary member 20 has two stoppers 242, 242A. One stopper 242 is formed inside the first casing 21, and the other stopper 242A is formed inside the second casing 22.

Figure 5:
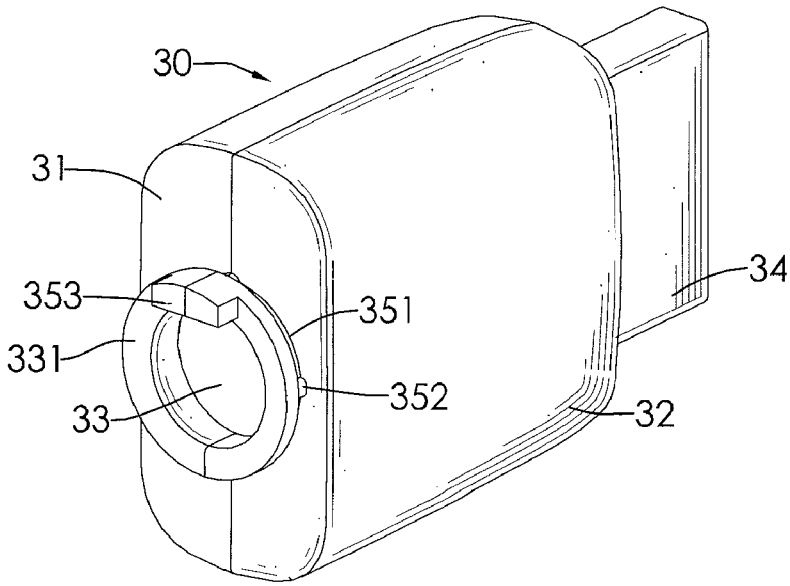
FIG. 5 is an enlarged perspective view of an insertion member of the biaxially rotatable electrical connector in FIG. 2.
Figure 8:
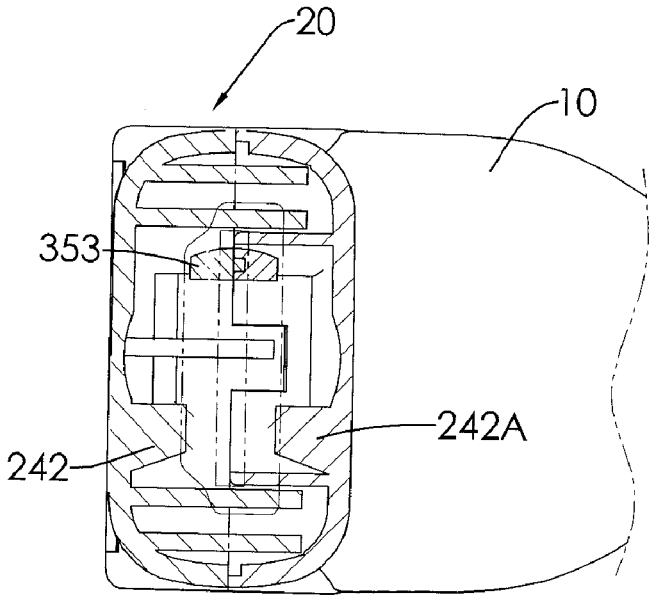
FIG. 8 is another operational top view in partial section of the biaxially rotatable electrical connector in FIG. 1A.
Figure 9:
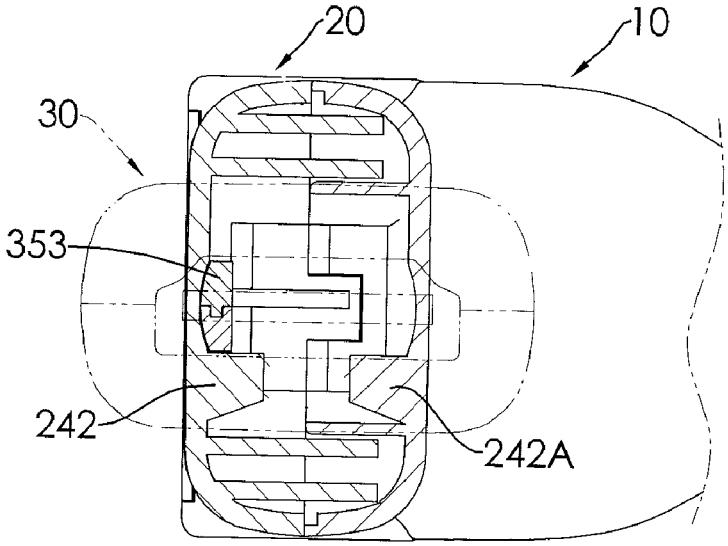
FIG. 9 is a further operational top view in partial section of the biaxially rotatable electrical connector in FIG. 1A.

With reference to FIG. 5, the insertion member 30 of the rotary part (T) is hollow, and has a first end, a second end, a through hole 33 and a rotation collar 331. The first end and the second end are mutually opposite. The through hole 33 is formed through the first end of the insertion member 30. The rotation collar 331 is formed on and protrudes outwardly and radially from an opening of the through hole 33, engages the second pivot opening 24 of the rotary member 20, and has an annular groove 351, multiple positioning bumps 352 and an positionable block 353. The annular groove 351 is formed in an outer wall of the rotation collar 331. The positioning bumps 352 are formed on the annular groove 351, are rotatable around the Z-axis to selectively engage corresponding second positioning cavities 241 of the second pivot opening 24, and may be equiangularly spaced apart with an angle, for example 90°. With further reference to FIGS. 8 and 9, the positionable block 353 is formed on a free end of the rotation collar 331, and is blocked by the stoppers 242, 242A inside the rotary member 20 when rotated. In the present embodiment, the insertion member 30 is a male HDMI connector, and a terminal connector 34 is mounted on the second end of the insertion member 30.

The insertion member 30 is composed of a first shell 31 and a second shell 32 oppositely joined together to form the insertion member 30. The first shell 31 has at least one engagement hook 36 formed on an inner wall of the first shell 31. The second shell 32 has at least one engagement recess 37 formed in an inner wall of the second shell 32 to correspond to and engage the at least one engagement hook 36.

Figure 6:
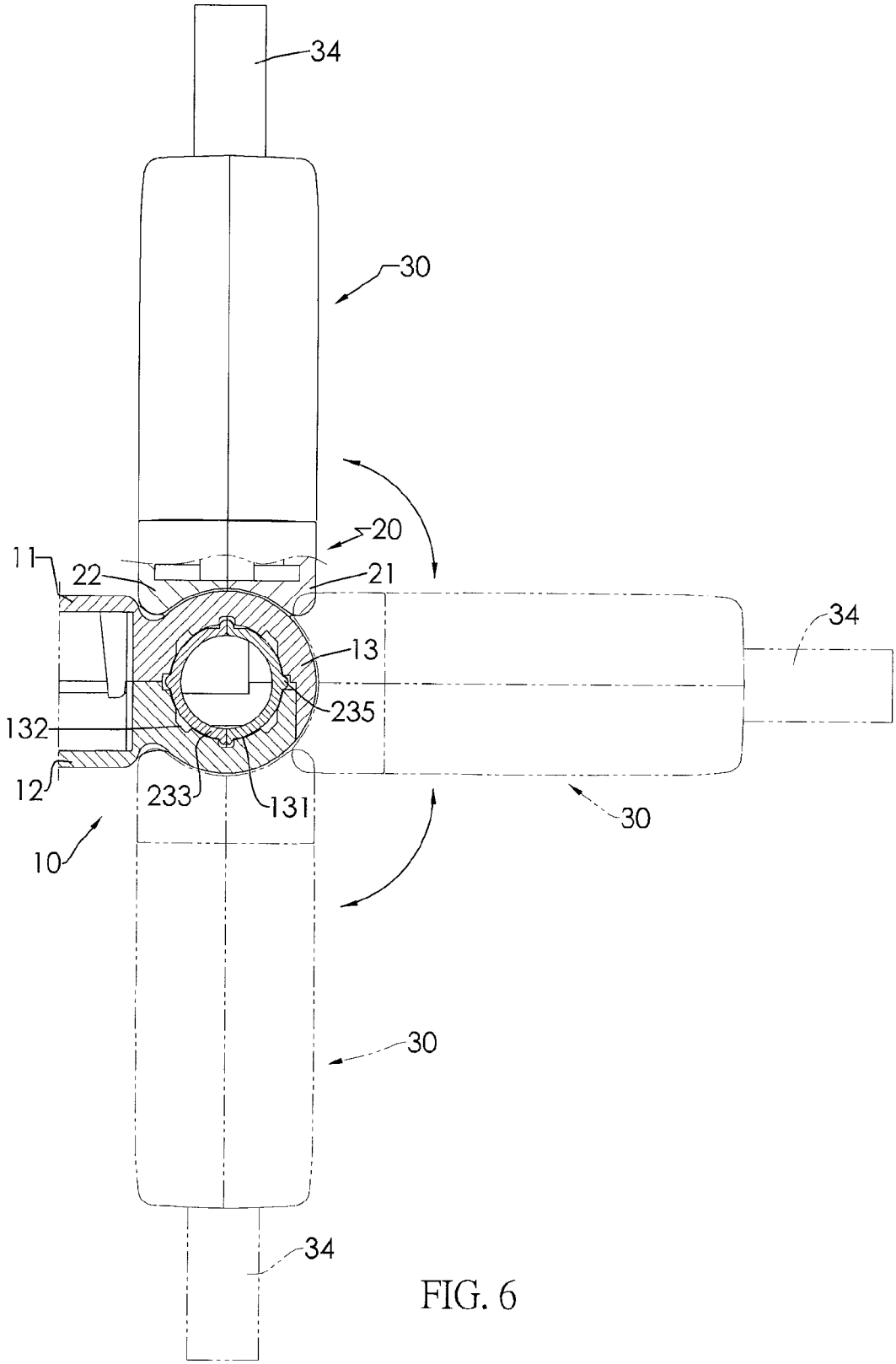
FIG. 6 is an operational side view in partial section of the biaxially rotatable electrical connector in FIG. 1A.

With reference to FIGS. 1, 2 and 6, the pivoting cylinder 23 is pivotally connected between the holding arms 13, 14 of the base 10, and can be rotated 90° up or down with respect to the X-axis. For every 45° that the rotary member 20 is rotated, the positioning teeth 235, 236 on the pivoting rings 233, 234 of the rotary member 20 engage different corresponding first positioning cavities 132, 142 of the first pivot opening 131, 141 of the base 10. In other words, the rotary member 20 is positioned after being rotated every 45°, and can be rotated again after a force is exerted. When the rotary member 20 is rotated 90° up and is perpendicular to the base 10, the second casing 22 of the rotary member 20 abuts against the upper housing 11 of the base 10 and is thus unable to be further rotated. When the rotary member 20 is rotated 90° down and is perpendicular to the base 10, the first casing 21 of the rotary member 20 abuts against the lower housing 12 of the base and is thus unable to be further rotated.

Figure 7:
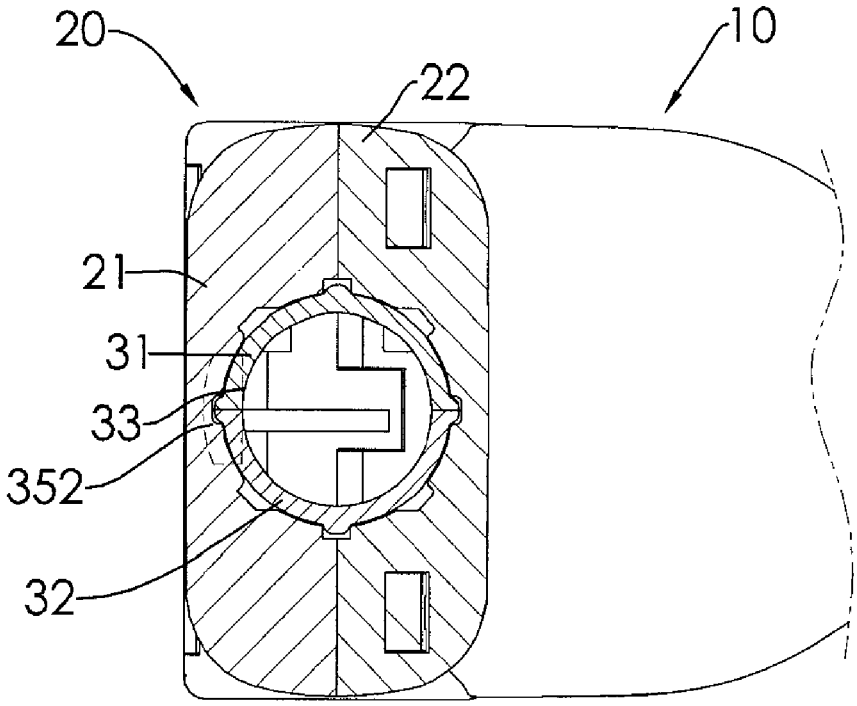
FIG. 7 is an operational top view in partial section of the biaxially rotatable electrical connector in FIG. 1A.
Figure 10:
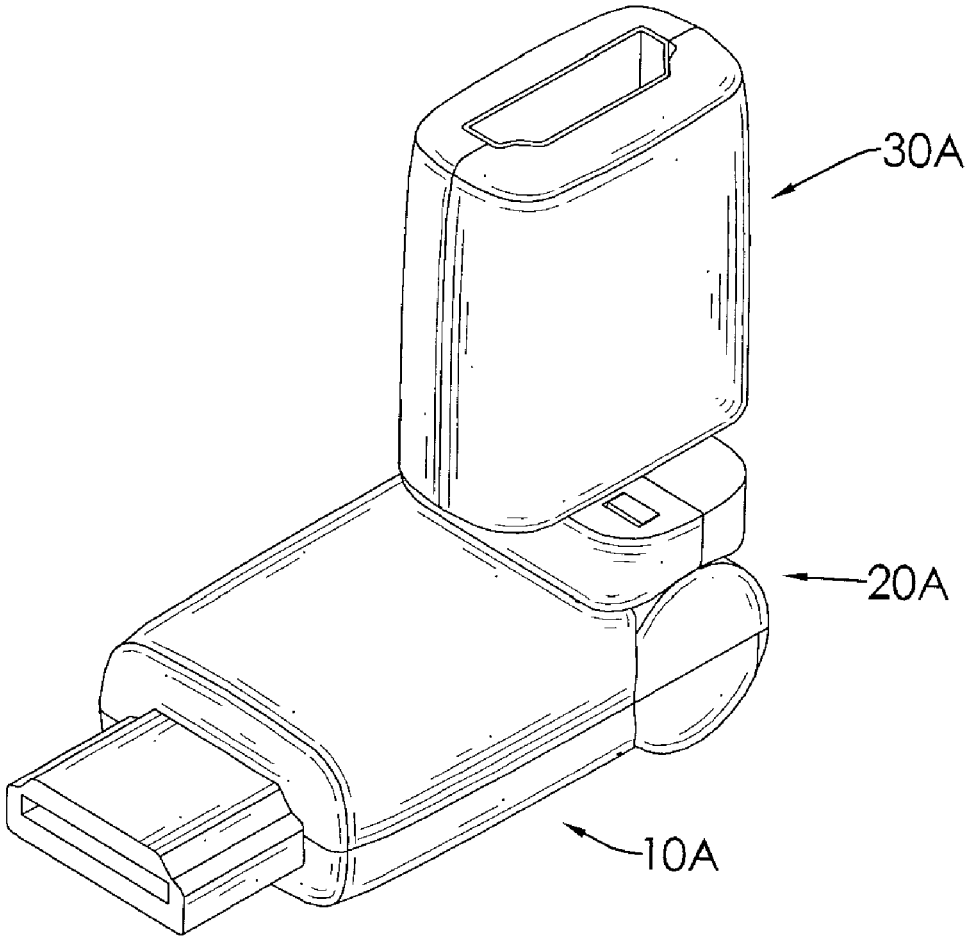
FIG. 10 is a perspective view of a second embodiment of a biaxially rotatable electrical connector in accordance with the present invention.

With reference to FIG. 7, for every 45° that the insertion member 30 is rotated, the positioning bumps 352 on the rotation collar 331 of the insertion member 30 selectively engage different corresponding second positioning cavities 241 on the second pivot opening 24 of the rotary member 20. The insertion member 30 is positioned after being rotated every 45°, and can be rotated again after a force is exerted. With reference to FIG. 8, when the insertion member 30 is not rotated, the positionable block 353 on the rotation collar 331 is away from the stoppers 242, 242A of the second pivot opening 24 of the rotary member 20. With reference to FIG. 9, when the insertion member 30 is rotated 90° counterclockwise, the positionable block 353 on the rotation collar 331 is stopped by the stopper 242 of the second pivot opening 24 of the rotary member 20, and the insertion member 30 is thus unrotatable. When the insertion member 30 is rotated 90° clockwise, the positionable block 353 on the rotation collar 331 is stopped by the stopper 242A of the second pivot opening 24 of the rotary member 20, and the insertion member 30 is thus unrotatable. As a result, a range of rotation of the insertion member 30 is limited under 180°. With reference to FIG. 10, a second embodiment of a biaxially rotatable electrical connector in accordance with the present invention is shown. The base 10A is a male HDMI connector, and the insertion member 30A is a female HDMI connector. The base 10 may be a female HDMI connector, RJ45 plug, USB plug, a tail of a transmission cable and the like. The rotary member 30 may be a male HDMI connector, RJ45 plug, USB plug, a tail of a transmission cable and the like.

As the rotary member 20 is pivotally connected with the base 10 and is rotated around the X-axis, and the insertion member 30 is also pivotally connected with the rotary member 20 and is rotated around the Z-axis, the electrical connector of the present invention can be biaxially rotatable. When the insertion member 30 is inserted in a corresponding connector of an electronic device, the electrical connector can vary its orientation biaxially in a linear, L-shaped or twisted form, so as not to conflict with other adjacent electrical connector already plugged in. When the base 10 is connected with a transmission cable 15, orienting the plug-in direction of the electrical connector does not have to deal with bending the transmission cable 15. Accordingly, there is no concern for reserving space for a bent transmission cable 15 and breaking off the transmission cable 15 after the transmission cable is bent for a prolonged period.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A biaxially rotatable electrical connector comprising:

a base being hollow and having two holding arms formed on one end of the base, wherein each holding arm is hollow and has:

an inside surface facing that of the other holding arm;

a first pivot opening formed through the inside surface of the holding arm; and multiple first positioning cavities formed in an inner wall of the first pivot opening;

a rotary part having:

a rotary member being hollow and having:

a first end and a second end being mutually opposite;

a pivoting cylinder having:

a through hole formed through the pivoting cylinder; and two pivoting rings respectively formed around and protruding outwardly from two openings of the through hole of the pivoting cylinder, and respectively engaging the first pivot openings of the holding arms, each pivoting ring having multiple positioning teeth formed on a periphery of the pivoting ring, and rotatable around a first axis to engage selectively corresponding first positioning cavities of the first pivot opening of a corresponding holding arm; and a second pivot opening formed through a second end of the rotary member; and an insertion member being hollow and having:

a through hole formed through one end of the insertion member; and a rotation collar formed on and protruding outwardly and radially from an opening of the through hole of the insertion member, engaging the second pivot opening of the rotary member and rotatable around a second axis.

2. The biaxially rotatable electrical connector as claimed in claim 1, wherein the second pivot opening of the rotary member has multiple second positioning cavities formed in an inner wall of the second pivot opening;

the rotation collar of the insertion member further has:

an annular groove formed in an outer wall of the rotation collar; and multiple positioning bumps formed on the annular groove, and rotatable around the second axis to engage selectively corresponding second positioning cavities of the second pivot opening of the rotary member.

3. The biaxially rotatable electrical connector as claimed in claim 2, wherein the rotary member further has multiple stoppers formed on an inner wall of the rotary member and being adjacent to the second pivot opening; and the rotation collar of the insertion member further has a positionable block formed on a free end of the rotation collar.

4. The biaxially rotatable electrical connector as claimed in claim 3, wherein the first positioning cavities are equiangularly spaced apart by 45°; and the positioning teeth are equiangularly spaced apart.

5. The biaxially rotatable electrical connector as claimed in claim 4, wherein the second positioning cavities are equiangularly spaced apart by 45°; and the positioning bumps are equiangularly spaced apart.

6. The biaxially rotatable electrical connector as claimed in claim 5, wherein the base is composed of an upper housing and a lower housing oppositely joined together to form the base;

the rotary member has a first casing and a second casing oppositely joined together to form the rotary member; and the insertion member has a first shell and a second shell oppositely joined together to form the insertion member.

7. The biaxially rotatable electrical connector as claimed in claim 6, wherein each of the upper housing and the lower housing has a first end and a second end, each holding arm is divided into an upper holding arm and a lower holding arm respectively formed on the first end of the upper housing and the first end of the lower housing, the upper housing has two insertion holes respectively formed through the upper holding arms, and the lower housing has two insertion blocks respectively formed on the lower holding arms to engage respectively the insertion holes of the upper housing.

8. The biaxially rotatable electrical connector as claimed in claim 7, wherein each of the first casing and the second casing has a first end and a second end, the pivoting cylinder is divided into a first pivoting cylinder and a second pivoting cylinder respectively formed on the first end of the first casing and the first end of the second casing and oppositely joined together to form the pivoting cylinder;

the first casing has:

an engagement block formed on and protruding from an inner wall of the first pivoting cylinder; and a pair of buckle tongues formed on and protruding from the second end of the first casing;

the second casing has:

an engagement hole formed in an inner wall of the second pivoting cylinder, and corresponding to and engaging the engagement block of the first casing; and a pair of buckle cavities formed in the second end of the second casing, and corresponding to and engaging the pair of buckle tongues of the first casing.

9. The biaxially rotatable electrical connector as claimed in claim 1, wherein the base is a male HDMI connector, and the insertion member is a female HDMI connector.

10. The biaxially rotatable electrical connector as claimed in claim 2, wherein the base is a male HDMI connector, and the insertion member is a female HDMI connector.

11. The biaxially rotatable electrical connector as claimed in claim 3, wherein the base is a male HDMI connector, and the insertion member is a female HDMI connector.

12. The biaxially rotatable electrical connector as claimed in claim 4, wherein the base is a male HDMI connector, and the insertion member is a female HDMI connector.

13. The biaxially rotatable electrical connector as claimed in claim 5, wherein the base is a male HDMI connector, and the insertion member is a female HDMI connector.

14. The biaxially rotatable electrical connector as claimed in claim 6, wherein the base is a male HDMI connector, and the insertion member is a female HDMI connector.

15. The biaxially rotatable electrical connector as claimed in claim 7, wherein the base is a male HDMI connector, and the insertion member is a female HDMI connector.

16. The biaxially rotatable electrical connector as claimed in claim 8, wherein the base is a male HDMI connector, and the insertion member is a female HDMI connector.

* * * * *